US006263943B1

(12) United States Patent
Lai

(10) Patent No.: US 6,263,943 B1
(45) Date of Patent: Jul. 24, 2001

(54) ROLLING SHUTTER FOR STORE WINDOWS OR DOORS

(75) Inventor: Man-Chi Lai, Aberdeen (CN)

(73) Assignee: Miu-Ha Chu, Aberdeen (CN)

( * ) Notice: Subject to any disclaimer, the term of this patent is extended or adjusted under 35 U.S.C. 154(b) by 0 days.

(21) Appl. No.: 09/210,355

(22) Filed: Dec. 11, 1998

(30) Foreign Application Priority Data

Dec. 17, 1997 (CN) ..... 97229847

(51) Int. Cl.[7] ..... E06B 9/08
(52) U.S. Cl. ..... 160/133; 160/236
(58) Field of Search ..... 160/133, 201, 160/232, 235, 236, 229.1, 127, 237; 256/26

(56) References Cited

U.S. PATENT DOCUMENTS 2,642,018 * 6/1953 Weeber ..... 160/133
2,831,537 * 4/1958 Ritter ..... 160/229.1
3,092,870 * 6/1963 Baer ..... 160/229.1
3,139,958 * 7/1964 DeWitt ..... 160/229.1
3,962,827 * 6/1976 Chaffee ..... 160/229.1
4,718,472 * 1/1988 Hormann ..... 160/229.1
5,025,847 * 6/1991 Mueller ..... 160/133
5,070,925 * 12/1991 Paule ..... 160/133
5,099,904 * 3/1992 Susnar ..... 160/229.1
5,265,663 * 11/1993 Munekata et al. ..... 160/133
5,575,322 * 11/1996 Miller ..... 160/133
5,782,282 * 7/1998 Chen ..... 160/229.1

FOREIGN PATENT DOCUMENTS 0 501 881 B1 6/1996 (EP) .

* cited by examiner

*Primary Examiner*—Daniel P. Stodola
*Assistant Examiner*—Curtis A. Cohen
(74) *Attorney, Agent, or Firm*—Alix, Yale & Ristas, LLP

(57) ABSTRACT

A modular rolling shutter for store windows and doors, comprised of vertically alternating rows of buckles and slats. Each slat is linked with the lower and upper buckles, allowing limited movement of the slats and buckles so that the modular shutter may be rolled and unrolled along tracks. The slats may be made of a transparent material allowing visibility without sacrificing weather resistance or security. Rolling shutters of various sizes which have the advantages of corrosion resistance, ease of transport, manufacture and repair can be easily formed.

23 Claims, 6 Drawing Sheets

ROLLING SHUTTER FOR STORE WINDOWS OR DOORS

BACKGROUND OF THE INVENTION

This invention relates to a rolling shutter, more particularly to a rolling shutter used for protection of store windows or doors.

Traditional metal rolling shutters are installed to guard stores against possible break-in and vandalism when the store is closed. Generally, a pair of tracks are provided on either side of the window or door. The shutter is rolled up along tracks to leave the window exposed during business hours, and unrolled down and secured upon closing, thereby covering and protecting the opening.

Conventional metal shutters are comprised of a plurality of shutter slats made of aluminum or steel. Conventional shutters present difficulties in manufacture, delivery, installation and repair. Moreover, when the conventional shutter is lowered, goods cannot be seen through the shutter. To make showcased goods visible, openings may be left in a conventional shutter. Unfortunately, openings expose goods to the elements and the possibility of damage or theft. Therefore, it is absolutely necessary to provide a shutter through which interior articles can be observed when the shutter is unrolled, and which is simple to manufacture, repair, deliver and install as well.

SUMMARY OF THE INVENTION

An object of the invention is to provide a rolling shutter for store windows and doors, which can be easily assembled into various sizes.

Another object of the invention is to provide a rolling shutter for store windows and doors which is formed from materials less susceptible to corrosion than the shutters formed entirely of a metallic material.

A further object of the invention is to provide a rolling shutter, which is simple to repair and clean while allowing articles behind the shutter to remain visible in the unrolled position.

Still another object of the invention is to provide a more weather resistant rolling shutter.

The objects of the invention are accomplished by providing a modular rolling shutter, which is comprised of alternating rows of buckles and slats. Upper and lower channels are provided on the upper and lower sections of each buckle. Upper and lower articulate edges are provided on the upper and lower sections of each slat. The interior dimensions and shape of the buckle channels are adapted to hold the articulate edges of the slats, while allowing enough movement so that the shutter can be rolled or unrolled. The left and right sides of adjacent slats abut each other, and may be rigidly joined.

The advantages of the rolling shutter of the invention relate to the ease with which the components can be assembled into an appropriate size, along with considerable strength, simplicity in manufacture, repair and delivery as well as improved corrosion resistance and transparency.

BRIEF DESCRIPTION OF THE DRAWINGS

Embodiments of the invention shall be described by referring to the accompanying drawings, wherein like reference numerals indicate like elements throughout the views.

DESCRIPTION OF THE PREFERRED EMBODIMENTS

Figure 1:
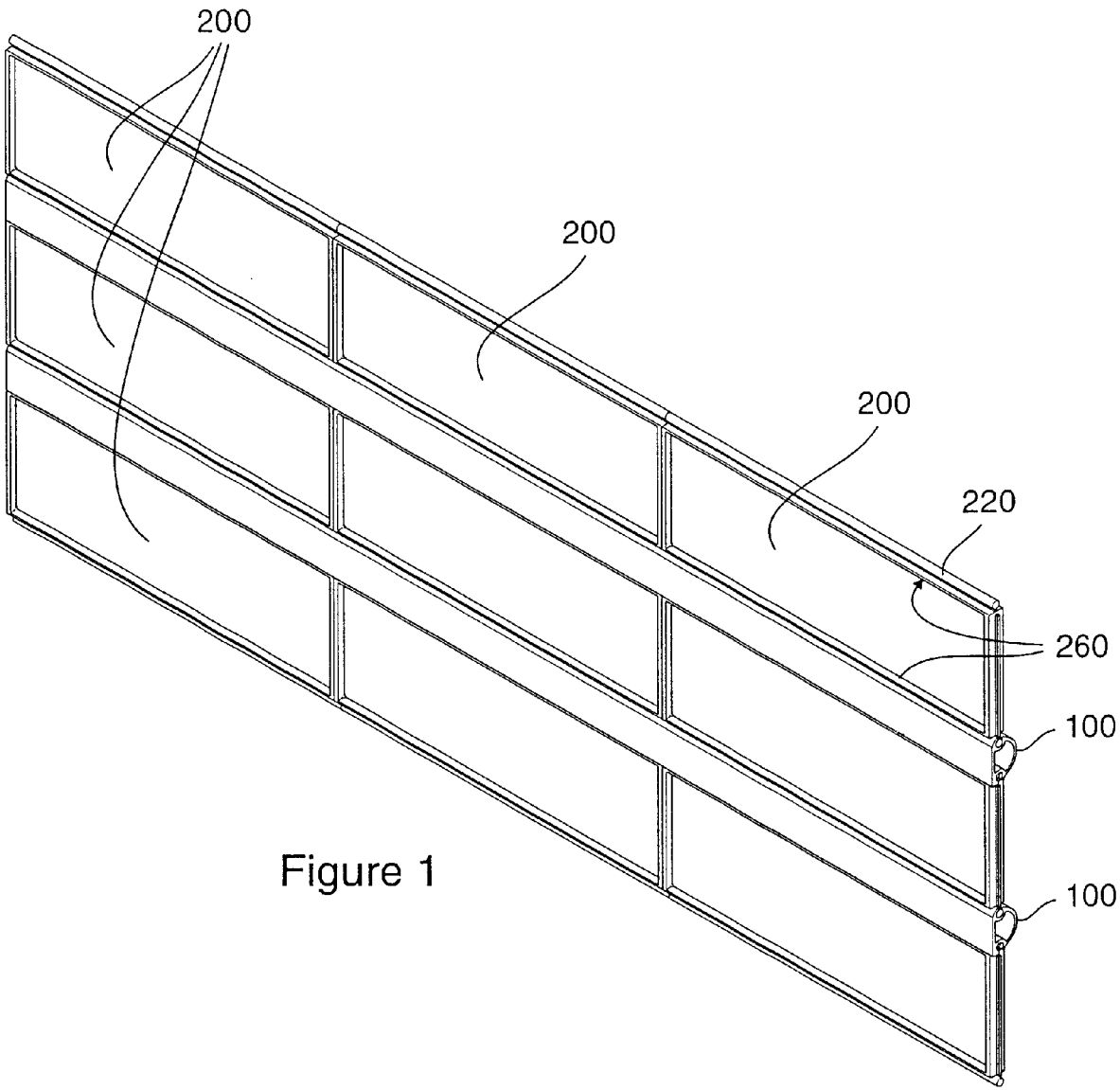
FIG. 1 is a schematic view, in perspective, showing the general arrangement of part of a rolling shutter of the invention.

Referring to FIG. 1, the rolling shutter comprises alternating rows of buckles 100 and slats 200, interconnected piece by piece. The width of the buckle 100 is designed to correspond to the width of the shutter tracks (not shown) on either side of a window or door. A row of adjacent slats are provided between, and linked with, the buckles 100 above and below. These alternating rows are repeated as necessary to form a modular rolling shutter of any required size. The upper and lower ends of the rolling shutter may be buckles 100, slats 200 or some other fitting (not shown).

Figure 2:
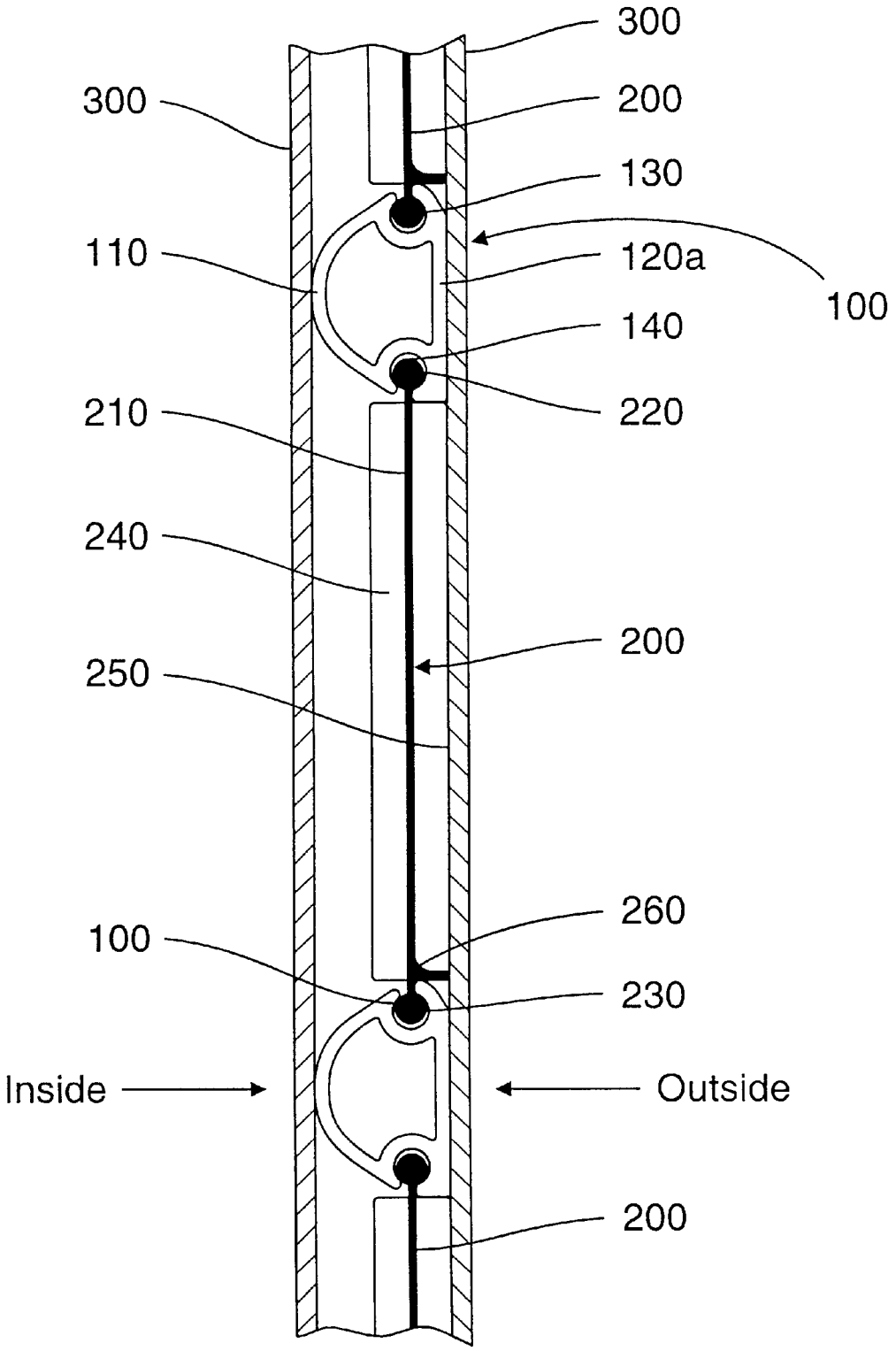
FIG. 2 is a sectional end view, showing the structure and connection for a section of the rolling shutter of the invention.

The construction of the rolling shutter and its operation are illustrated in FIG. 2. The shutter is rolled and unrolled between two parallel tracks 300. The heavy and light arrows indicate the respective viewing direction from inside and outside of the rolling shutter. The buckle 100 is an integral member, comprising an inner surface 110, an outer surface 120*a*, an upper channel 130 and a lower channel 140. The inner surface 110 and the outer surface 120*a* at the ends of the buckle are in sliding contact with the track 300. The upper channel 130 and the lower channel 140 have openings that allow the buckle 100 to link at opposing locations (upper and lower as illustrated in FIG. 2) with corresponding parts of adjacent slats 200.

Each slat 200, comprises an integral slat body 210, an upper articulate edge 220 and a lower articulate edge 230. The slat may also include reinforced sides 240, 250 and a dasher 260.

The upper and lower buckles 100 are linked with intermediate, upper and lower slats 200. As shown in FIG. 2, the slat upper articulate edge 220 is linked with the lower channel 140 of the buckle 100 vertically above it. The lower articulate edge 230 is linked with the upper channel 130 of the buckle 100 vertically below it.

Configurations of the channels 130, 140 are complementary to the articulate edges 230, 220 and may be varied for different applications. The opening, formed in both the upper and lower channels, gives the slat 200 a restricted range of rotation within the channels, thus allowing the shutter to be rolled or unrolled.

The buckle 100 of the invention is made of metal, preferably aluminum. Other metals, such as steel, stainless steel, etc. may be used depending upon considerations of corrosion-resistance, strength, rigidity, price and aesthetics. The cross-sectional area of the buckle in one embodiment can be 30 mm×15 mm, although buckles of other dimensions will fall within the scope of this invention.

Figure 3:
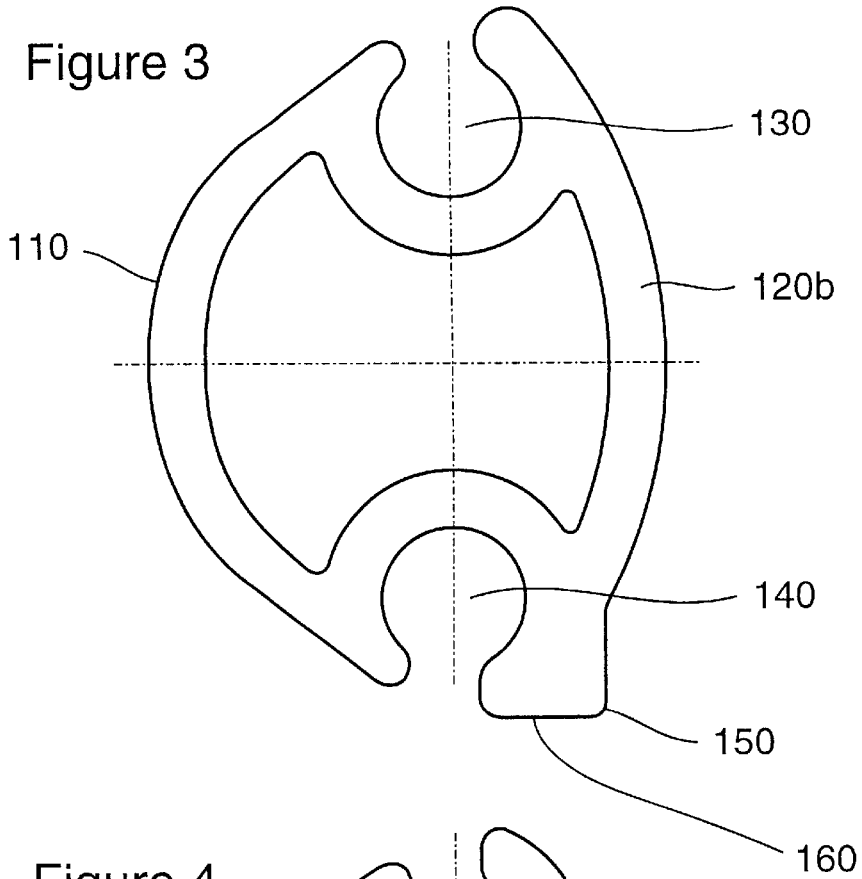
FIG. 3 is a schematic, sectional view of one embodiment of a buckle, showing a convex outer surface.

Referring to FIG. 3, an embodiment of the buckle 100 of the rolling shutter is shown. It has a tubular-shaped, thin shell structure. The inner surface 110 and the outer surface 120*b* are curved. The curvature results in a small sliding contact area between the track 300 and the buckle inner and outer surfaces 110, 120*b* sliding therein, so that the rolling shutter can be more easily raised or lowered. The configurations of the upper channel 130 and the lower channel 140 are illustrated in the drawing. The channels are circular in cross section, and have defined openings.

The portion of the outer surface 120*b* adjacent to the upper channel 130 of the buckle is angled obliquely inwardly and the portion of the outer surface 120*b* adjacent to the lower channel 140 is planar, so that rainwater will flow down the outer surface of the buckle body. The buckle base 160 is angled obliquely upwards, to prevent rainwater from flowing to the inner surface 110.

The portion of the outer surface 120*b* adjacent to the lower channel 140 is also substantially perpendicular to the base surface 160, forming a strengthening fillet 150 at the intersection. The use of curved sections for the structure of the buckle 100 greatly enhances its strength.

Figure 4:
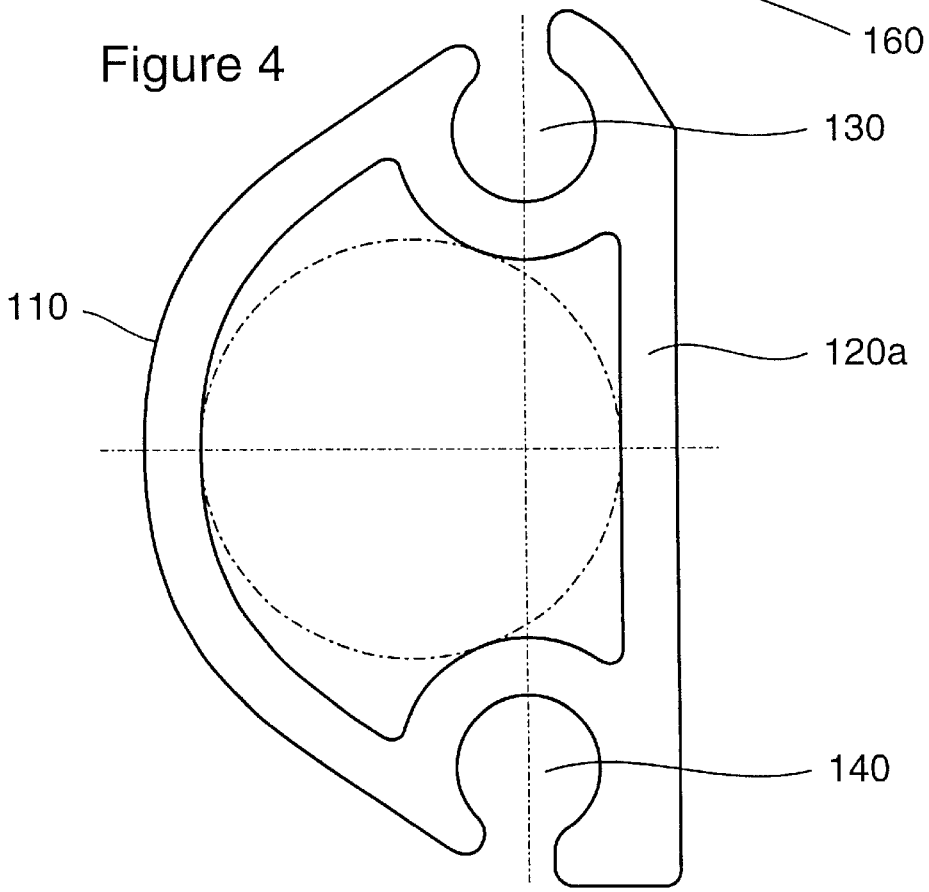
FIG. 4 is a schematic, sectional view, showing a flat outer surface of another embodiment of the buckle with a reinforcing rod (shown in phantom) inserted within the buckle body.

Another embodiment of the buckle 100 is shown in FIG. 4. This embodiment has an outer surface 120*a* that is substantially flat. The flat outer surface increases contact with, and thereby stability within, the track 300. The portion of the outer surface 120*a* which is adjacent to the upper channel 130 is angled obliquely inwardly and the portion of the outer surface 120*a* which is adjacent to the lower channel 140 is planar, as in the embodiment shown in FIG. 3.

In some embodiments, a hollow space is defined within the body of the buckle, as shown in FIG. 4. A cylindrical metal rod can be inserted into this space, as shown by the dotted circle. The strength of the buckle is enhanced by this method.

Figure 12:
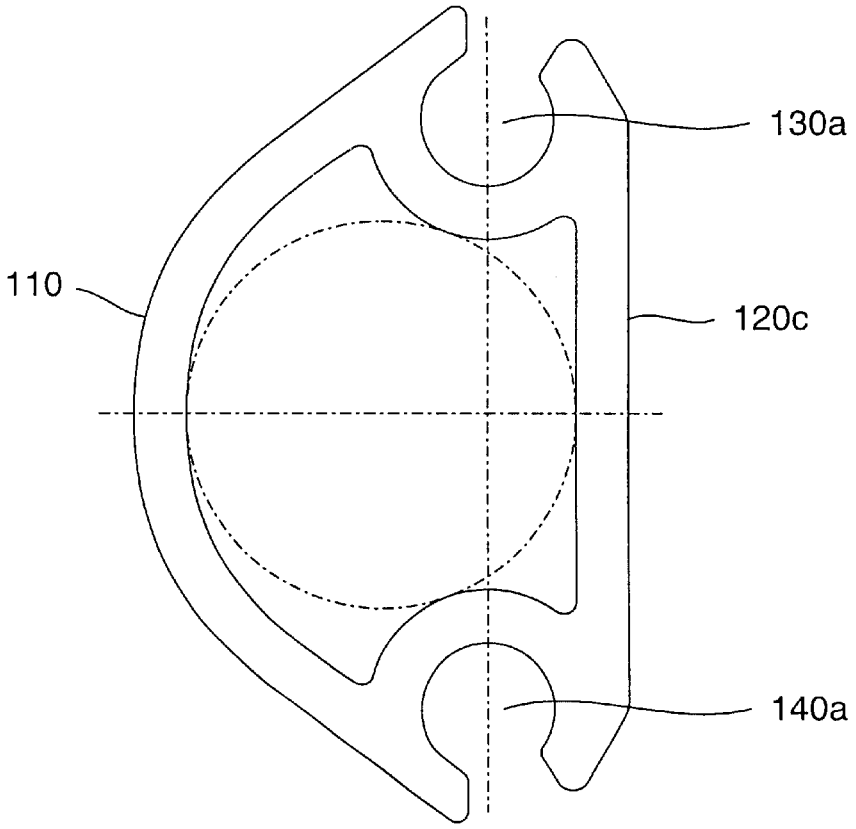
FIG. 12 is a sectional, schematic view, showing another embodiment of the buckle adapted so that the shutter can be rolled outwardly.

The buckle embodiment shown in FIG. 12 differs from previous embodiments in the orientation and position of the openings of the upper channel 130*a* and lower channel 140*a*. In FIG. 3 and FIG. 4, the upper and lower openings face the inner surface 110, so that the shutter can be rolled inwardly. In the embodiment shown in FIG. 12, the upper and lower openings face the outer surface 120*c*, so that the shutter can be rolled outwardly.

Each slat 200 is preferably made of a nonmetallic material, such as plastic, or glass-fiber reinforced plastic in order to obtain the advantages of lightweight and transparency. Transparent materials are preferable because articles behind the closed shutter can be seen. However, all or some of the slats can also be made from metal, such as aluminum.

The slats are preferably all identical to ease maintenance and assembly. The slat 200 may be rectangular or square, with dimensions, as an example, of about 10 cm×20 cm, and a thickness in the middle of the main portion ranging from 2 mm to 5 mm. These dimensions are exemplary and rolling shutters of other dimensions will fall within the scope of the invention.

Figure 5:
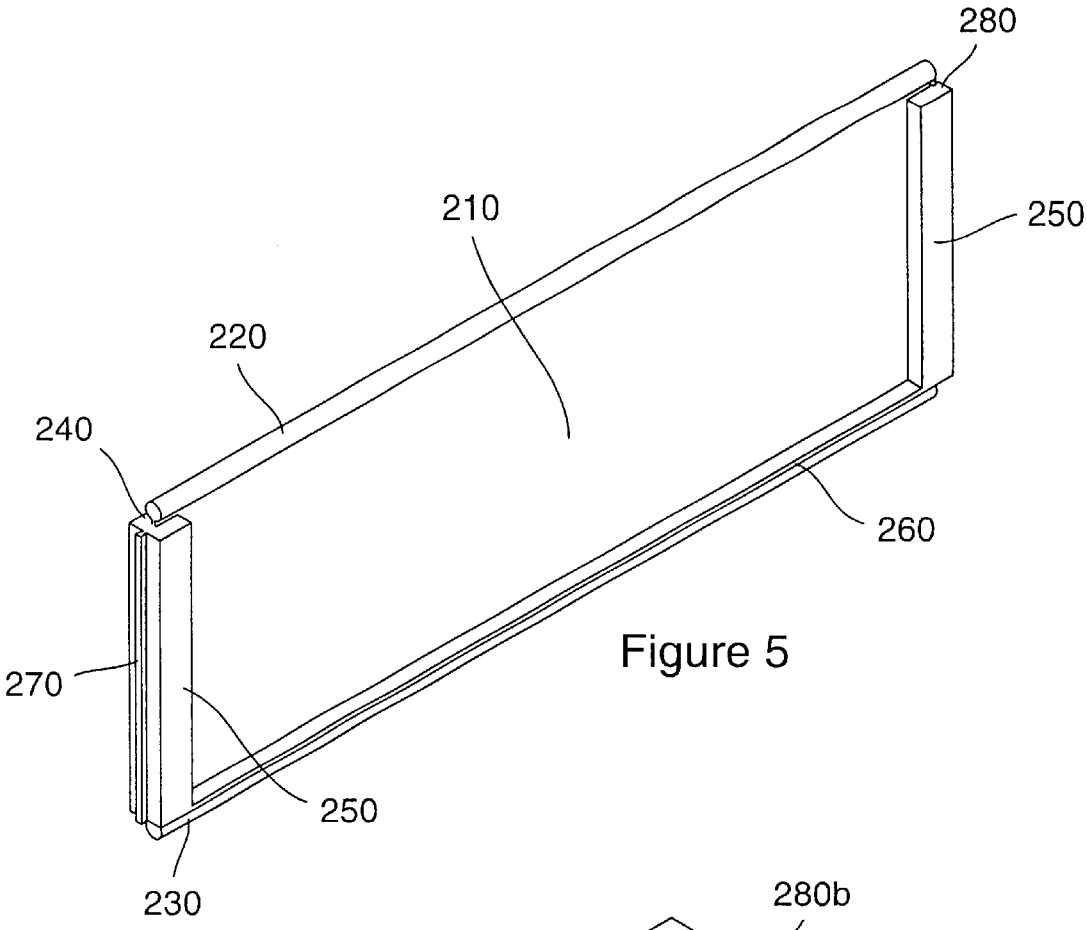
FIG. 5 is a perspective view of the slats of the rolling shutter according to one embodiment of the invention.
Figure 6:
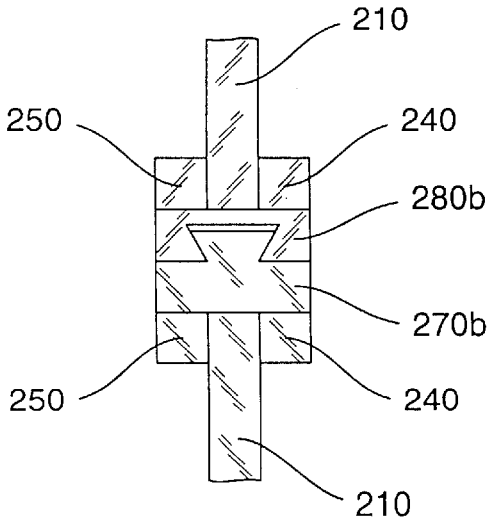
FIG. 6 is a fragmentary top view of one embodiment, showing the interconnection between the left side and the right side of adjacent slats.

One embodiment of the slat 200 is shown in FIG. 5. The slat has a generally rectangular shape, and may be integrally molded to comprise a slat body 210, an upper articulate edge 220, a lower articulate edge 230, inner reinforced sides 240, outer reinforced sides 250 and a dasher 260. Each articulate edge 220, 230 preferably extends the length of the slat and has a substantially uniform cross-section defined by a connecting shape. As shown in FIG. 5 the connecting shape is circular, although different connecting shapes are possible. The inner reinforced sides 240 and outer reinforced sides 250 are provided on the inside and outside faces, respectively, at both ends of the slat body 210. The inner and outer reinforced sides 240, 250 are in the shape of a narrow strip and function as ribs, which considerably increase slat strength. In order to connect adjacent slats, a coupler 270 and 280 can be provided at the left and right sides of the slat 200. The couplers may be integrally molded with the slat body or separately attached. In some embodiments, the adjacent couplers have complementary mating shapes enabling the left side and right side of adjacent slats to interconnect. Further detail of the interconnection between two adjacent slats is shown in FIG. 6. This Figure shows portions of adjacent slats 210, along with their inner reinforced side 240, outer reinforced side 250, a male dovetail coupler 270*b* and the mating female dovetail coupler 280*b*.

Figure 7:
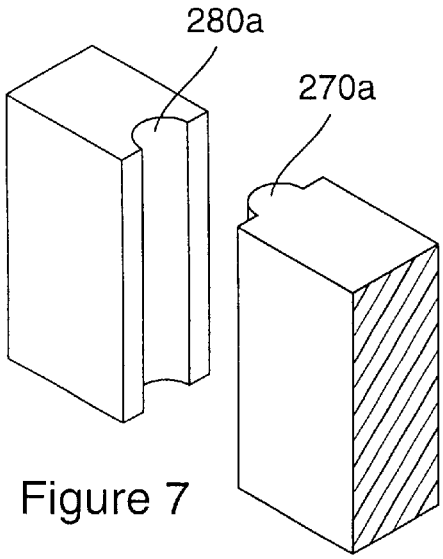
FIG. 7 is an illustration in perspective showing semi-cylindrical left and right side couplers for a slat.

FIG. 7 shows the left and right couplers for another embodiment of slat interconnection. The adjacent slat sides are connected by male and female semi-cylindrically shaped couplers 270*a*, 280*a*. In this configuration, adjacent slats are connected, but not rigidly joined.

Figure 8:
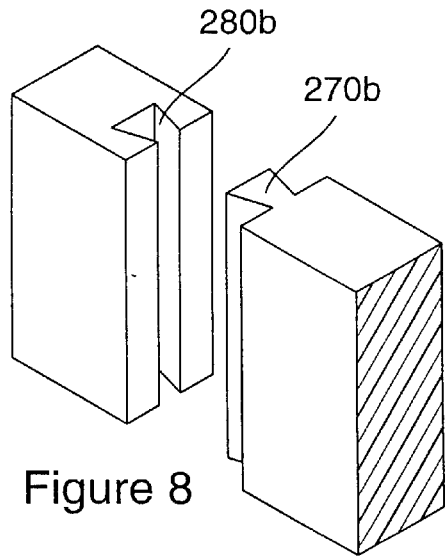
FIG. 8 is an illustration in perspective showing dovetailed left and right side couplers for a slat.

FIG. 8 shows a different embodiment of the slat interconnection, similar to that of FIG. 6. One coupler is a male dovetail 270*b*, and the mating coupler is a female dovetail 280*b*. The dovetailed couplers lock adjacent slats into a rigid row.

Figure 9:
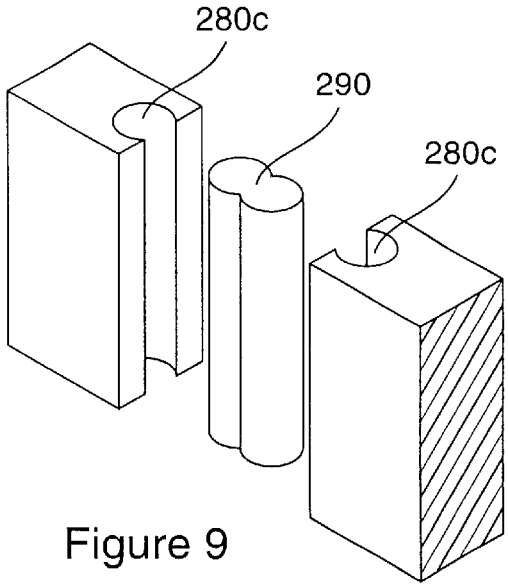
FIG. 9 is an illustration in perspective showing the left and right female couplers for a slat, and a complimentary insert by which adjacent couplers can be joined.

FIG. 9 is a further embodiment of slat interconnection. The left coupler 280*c* and the right coupler 280*c* are the same. Both have similar cylindrical recesses, with opening widths that are smaller than the diameter of the cylindrical recess. By mating the insert 290 with the recesses of adjacent slats, the adjacent slats are rigidly joined.

Figure 10:
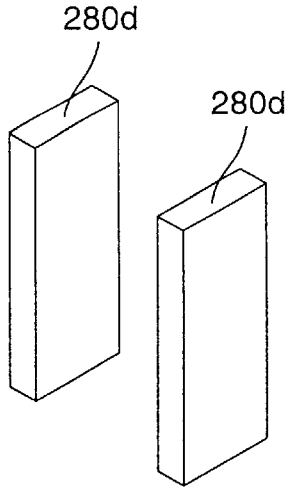
FIG. 10 is an illustration in perspective showing planar left and right couplers for a slat.

FIG. 10 shows another embodiment for slat interconnection. The left and right couplers 280*d* are the same, with both couplers having planar surfaces. The planar surface of the left side coupler 280*d* and the right side coupler 280*d* butt against each other. In this embodiment, adjacent slats are not connected and may move with respect to each other.

The dasher 260 of the slat 200 is shown in FIGS. 2 and 5. The dasher is an elongated member extending along the outside lower portion of the slat body 210. The projecting edge of the dasher acts as a drip edge, enabling rainwater flowing down the slat body to drip off the outer edge of dasher and away from the slat body. The dasher 260 may be manufactured as an integral part of the slat 200, or may be manufactured as a separate component and attached to the slat.

In other embodiments, the slat has no dasher. Since the materials and construction of the rolling shutter are waterproof and corrosion resistant, the dasher 260 may be removed to make the slat 200 simpler and more cost effective.

Figure 11:
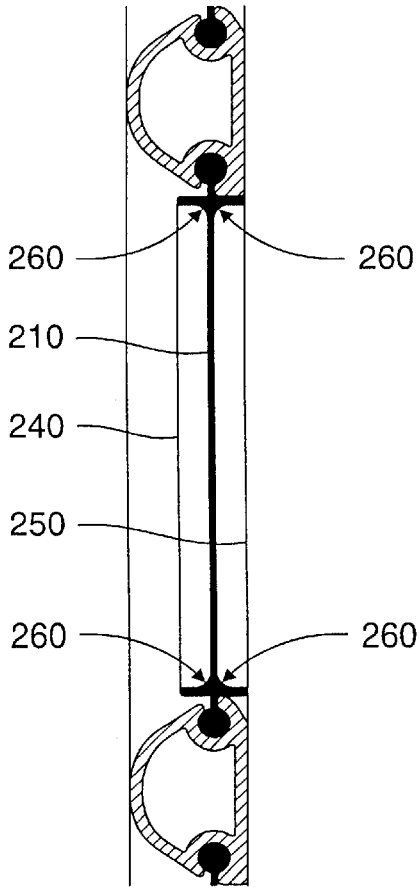
FIG. 11 is a sectional view, similar to FIG. 2, showing an embodiment of a slat having more than one dasher.

Alternatively, the slat may have more than one dasher, as shown in FIG. 11. In addition to a dasher 260 at the outer lower section of the slat, a dasher may also optionally be provided at the outer upper section, at the inner upper section and at the inner lower section. These optional dashers all have the same configuration. Although the slat becomes more complicated with the addition of multiple dashers, the resulting slat is more resistant to severe weather conditions and stronger.

Figure 13:
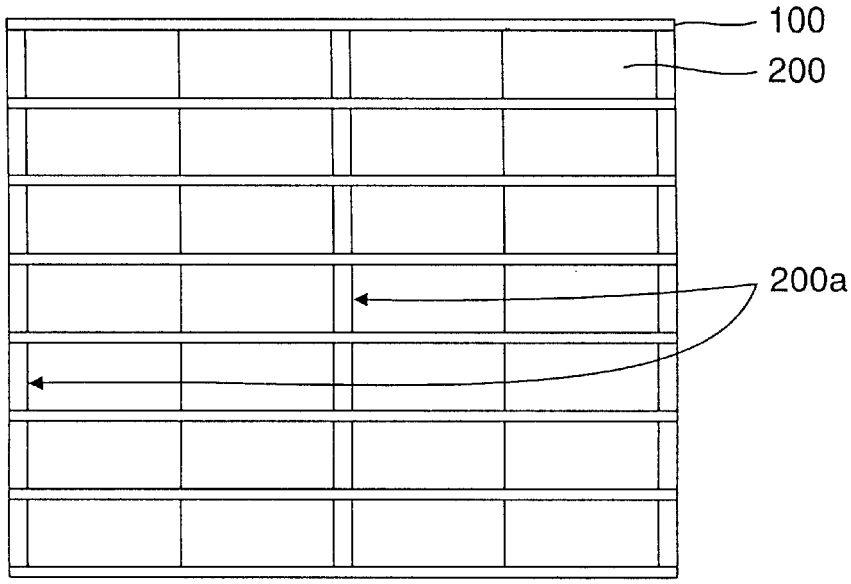
FIG. 13 is a frontal schematic view of an embodiment of the rolling shutter of the invention with plastic and metallic slats.

A different embodiment of the invention is shown in FIG. 13. The rolling shutter of this embodiment comprises slats and buckles, similar in structure and operation to previous embodiments, with the exception that the slats are made of plastic 200 and metal 200*a*. The metal slats 200*a* are positioned between the nonmetallic slats 200. The metal slat 200*a* is structurally similar to the plastic slat 200, but may have a smaller width, for example, 25–50 mm. The metal slat 200*a* can be positioned at any interval in the row of slats 200. Despite this hybrid structure, the transparency of the rolling shutter is only slightly affected while strength is enhanced, thus a more secure rolling shutter is obtained.

Since the slats and buckles are common, modular rolling shutters of various sizes can be quickly assembled and their parts can be easily repaired, cleaned and replaced. The drawbacks of conventional shutters, such as difficulty of repair, low light transmission, susceptibility to corrosion, etc., will be overcome by use of the inventive modular rolling shutter.

While preferred embodiments of the foregoing invention have been set forth for purposes of illustration, the foregoing descriptions should not be deemed a limitation of the invention herein. Accordingly, various modifications, adaptations and alternatives may occur to one skilled in the art without departing from the spirit and scope of the invention.

What is claimed is:

1. A rolling shutter, comprising:

a plurality of spaced buckles, each extending from a first end to a second end, each having an upper edge containing an upper channel, a lower edge containing a lower channel, an inner surface and an outer surface connecting the upper and lower edges;

a plurality of modular slat rows, each slat row being comprised of a plurality of slats, each slat having a body with an upper articulate edge, a lower articulate edge, a first side and a second side, at least one side comprising a coupler, each said modular slat row formed from slats joined by said couplers in a side by side configuration;

the buckles and the modular slat rows having an alternating sequence, the upper articulate edge of each slat in a modular slat row fitting within and being retained by the lower channel of a higher buckle, with the slats remaining free to articulate within the lower channel, and the lower articulate edge of each slat in the modular slat row fitting within and being retained by the upper channel of a lower buckle, with the slats remaining free to articulate within the upper channel.

2. A rolling shutter as in claim 1 wherein the buckles are comprised of metal.

3. A rolling shutter as in claim 1 wherein the buckles have a hollow shell structure.

4. A rolling shutter as in claim 3 wherein a reinforcing rod is inserted into said buckle hollow shell structure.

5. A rolling shutter as in claim 1, wherein at least one slat in the modular slat row consists of structurally rigid transparent material.

6. A rolling shutter as in claim 1 wherein the slats are comprised of metal.

7. A rolling shutter as in claim 1, wherein said modular slat rows are comprised of at least one plastic slat coupled with at least one metal slat.

8. A rolling shutter as in claim 1 wherein a portion of said outer surface adjacent to said upper edge angles obliquely inwardly.

9. A rolling shutter as in claim 1, wherein each slat further comprises an interior face and an exterior face connecting said upper and lower articulate edges, said outer face having at least one elongated member projecting away from and substantially perpendicular to the portion of said outer face adjacent to said lower articulate edge, said elongated member extending from said first side to said second side, whereby a liquid contacting said outer face will be directed away from said slat body and drip off said elongated member.

10. A rolling shutter as in claim 1 wherein openings in the upper and lower channels in each buckle face in an inner direction, thereby allowing rolling of the shutter in the inner direction.

11. A rolling shutter as in claim 1 wherein openings in the upper and lower channels in each buckle face in an outer direction, thereby allowing rolling of the shutter in the outer direction.

12. A rolling shutter as in claim 1 wherein said buckle further comprises a base surface connecting said lower channel with said outer surface, the portion of said outer surface adjacent to said bottom surface being perpendicular to said bottom surface and forming a strengthening fillet extending from said first end to said second end.

13. A rolling shutter comprising:

a plurality of spaced buckles, each extending from a first end slidably captured within a first track to a second end slidably captured within a second track, each having an upper edge containing an upper channel, a lower edge containing a lower channel, an inner surface and an outer surface connecting the upper and lower edges, each inner and outer surface comprising an inner and outer sliding surface at each captured end;

a plurality of modular slat rows, each slat row being comprised of a plurality of slats, each slat having a body with an upper articulate edge, a lower articulate edge, a first side and a second side, at least one said side comprising a coupler, said coupler configured to join said at least one side to an adjacent slat side;

the buckles and the modular slat rows having an alternating sequence, the upper articulate edge of each slat in the modular slat row fitting within and being retained by the lower channel of a higher buckle, with the slats remaining free to articulate within the lower channel, and the lower articulate edge of each slat in the row fitting within and being retained by the upper channel of a lower buckle, with the slats remaining free to articulate within the upper channel.

14. A rolling shutter as in claim 13 wherein said outer sliding surface is flat.

15. A rolling shutter as in claim 13 wherein said outer sliding surface is convex.

16. A rolling shutter as in claim 13 wherein said inner sliding surface is convex.

17. A rolling shutter, comprising:

first and second spaced tracks;

a plurality of spaced buckles, each extending from a first end slidably captured within the first track to a second end slidably captured within the second track, each having an upper edge containing an upper channel with a first internal shape, a lower edge containing a lower channel with a second internal shape, an inner surface and an outer surface connecting the upper and lower edges, each inner and outer surface comprising an inner and outer sliding surface at each captured end;

a plurality of modular slat rows, each modular slat row being comprised of a plurality of slats, each slat having a body with an upper articulate edge, a lower articulate edge, a first side, a second side, an inside face and an outside face, said slats being arranged in a side by side configuration, wherein abutting slat sides form couplers, said couplers joining said slats to form each said modular slat row, each said modular slat row extending from the first track to the second track;

the buckles and the modular slat rows having an alternating sequence, the upper articulate edge of each slat in a lower modular slat row fitting within and being retained by the shape of the lower channel of a higher buckle, with the slats remaining free to articulate within the lower channel shape, and the lower articulate edge of each slat in the modular slat row fitting within and being retained by the shape of the upper channel of a lower buckle, with the slats remaining free to articulate within the upper channel shape.

18. A rolling shutter as in claim 17, wherein at least one slat side includes a reinforcing rib, which projects away from and substantially perpendicular to at least one face.

19. A rolling shutter as in claim 17 wherein each coupler has a planar abutting side.

20. A rolling shutter as in claim 17 wherein at least one slat has at least one coupler with a female portion and at least one slat has at least one coupler with a male portion, the male portion of one slat coupler fitting within the female portion of an adjacent slat coupler.

21. A rolling shutter as in claim 20 wherein the male and female coupler portions have a complementary semi-cylindrical shape.

22. A rolling shutter as in claim 20 wherein the male and female coupler portions have a complementary dovetail shape, the male dovetail of one slat coupler fitting within the female portion of an adjacent slat coupler and rigidly joining the adjacent slats.

23. A rolling shutter as in claim 17 wherein at least two adjacent slat sides each further comprise a coupler with a female portion and a complementary insert fits within said female couplers rigidly joining the adjacent slats.

* * * * *